US009388641B1

(12) United States Patent
Metz et al.

(10) Patent No.: US 9,388,641 B1
(45) Date of Patent: Jul. 12, 2016

(54) SELF-POSITIONING SUBSTRUCTURE LOCKING MECHANISM

(71) Applicant: T&T Engineering Services, Inc., Tomball, TX (US)

(72) Inventors: Robert Metz, Cypress, TX (US); Mark W. Trevithick, Houston, TX (US)

(73) Assignee: T&T Engineering Services, Inc., Tomball, TX (US)

( * ) Notice: Subject to any disclaimer, the term of this patent is extended or adjusted under 35 U.S.C. 154(b) by 0 days.

(21) Appl. No.: 14/735,988

(22) Filed: Jun. 10, 2015

(51) Int. Cl.

| | |
|---|---|
| ***B66C 23/06*** | (2006.01) |
| ***B66C 23/62*** | (2006.01) |
| ***E04H 12/34*** | (2006.01) |
| ***E21B 15/00*** | (2006.01) |

(52) U.S. Cl.
CPC ..... *E21B 15/006* (2013.01); *E04H 12/345* (2013.01)

(58) Field of Classification Search
CPC ..... E21B 15/006; E21B 15/00; E21B 7/02; E04H 12/345; E04H 12/187; B66F 3/30; Y10T 292/1047; Y10T 292/1078; Y10T 292/1077
See application file for complete search history.

(56) References Cited

U.S. PATENT DOCUMENTS

| | | | | |
|---|---|---|---|---|
| 7,306,055 | B2 * | 12/2007 | Barnes | E21B 7/02 175/122 |
| 2009/0217717 | A1 * | 9/2009 | Mrkovic | E05B 47/0009 70/271 |
| 2012/0167485 | A1 * | 7/2012 | Trevithick | E21B 15/00 52/112 |
| 2013/0180186 | A1 * | 7/2013 | Konduc | E21B 15/00 52/119 |
| 2013/0269268 | A1 * | 10/2013 | Thiessen | E21B 15/00 52/118 |
| 2013/0291452 | A1 * | 11/2013 | Donnally | E21B 15/00 52/117 |
| 2015/0114717 | A1 * | 4/2015 | Fortson | E21B 15/003 175/57 |
| 2016/0060893 | A1 * | 3/2016 | Roodenburg | E21B 7/02 52/123.1 |

* cited by examiner

*Primary Examiner* — Brian Mattei
(74) *Attorney, Agent, or Firm* — John G. Fischer, Esq.; Scheef & Stone, L.L.P.

(57) ABSTRACT

The present invention discloses an automatic drill floor to substructure latching system that adds to the safety of drilling operations. In particular, the present invention is applicable for rapid and safe locked connection of a drilling rig side box to the drilling rig base box such that weight imbalances incurred when raising of the drilling rig mast will not result in unsecured and unsafe separation of the side box and base box.

14 Claims, 12 Drawing Sheets

SELF-POSITIONING SUBSTRUCTURE LOCKING MECHANISM

TECHNICAL FIELD OF INVENTION

The embodiments of the present invention relate to a novel mechanism that adds to the safety of drilling operations. In particular, the present invention is applicable for rapid and safe locking of a drilling rig substructure side box to the drilling rig base box such that the raising of the drilling rig mast will not result in unsecured and unsafe separation during mast raising and lowering.

BACKGROUND OF THE INVENTION

In the exploration of oil, gas and geothermal energy, drilling operations are used to create boreholes, or wells, in the earth. Drilling rigs used in subterranean exploration must be transported to the locations where drilling activity is to be commenced. These locations are often remotely located in rough terrain. The transportation of such rigs on state highways requires compliance with highway safety laws and clearance underneath bridges or inside tunnels. Once transported to the desired location, large rig components must each be moved from a transport trailer into engagement with the other components located on the drilling pad.

Moving a full-size rig requires disassembly and reassembly of the substructure and mast. Safety is of paramount importance. Speed of disassembly and reassembly is also critical to profitability. Complete disassembly leads to errors and delay in reassembly. When the substructure is assembled over the drilling pad, the mast is connected to the drill floor above the substructure. Each substructure side box is pin connected to its respective substructure base box. The drill floor center section is connected between the driller's side box and the off-driller's side box. The lower section of the mast is pin connected to the drill floor. The center mast section is pin connected to the lower mast section and the upper mast section is connected to the center mast section.

When the mast sections are connected together, the mast is raised by pivoting it on the pin connection to the drill floor. It is critical that the driller's side boxes remain secured to the base boxes during mast raising. Failing to properly secure them together results in their separation and collapse of the mast with significant damage to the entire structure and risk of injury or death to personnel. Once the mast has been raised over the drill floor, the side boxes are unpinned to disconnect then from the base boxes. Only then can the substructure can be raised.

It is desirable to have a connection system that is automated, to reduce rig-up and rig-down time. It is desirable to have a system that can be manually unlatched, and that automatically resets itself upon substructure raising. It is also desirable to have a system that latches automatically to speed the operation and to prevent accidents when an employee forgets to pin the side box to the base box. It is also desirable that the connection and disconnections be performed without the need to align the dog-ears (pin holes) for insertion of a pin.

More particularly, it is desirable to provide a substructure lock mechanism that cannot be left open when the side box is away. It is also desirable to provide a substructure lock mechanism that will automatically reset itself in a fairly short distance of raising the side box above the base box, such that if necessary to bring the side box back down for any reason during raising, the lock mechanism will re-engage.

The preferred embodiments of the present invention provide a unique solution to the engineering constraints and challenges of providing a rapid, safe, and reliable connection between the drill floor and substructure of a drilling rig.

SUMMARY OF THE INVENTION

The present invention provides a mechanism for automatic and secure connection of the side box of a drilling rig substructure to the base box of the drilling rig substructure, as well as rapid release, reset, and self-alignment. The substructure lock system provided requires the weight of the side box to keep the latch open, where upon separation of the side box from the base box, the latch automatically resets itself.

The lock system comprises a strike affixed to a bottom side of a side box portion of a drilling rig substructure. The substructure lock mechanism is affixed to a top side of a base box portion of the drilling rig substructure. The substructure lock mechanism comprises a housing and a latch pivotally connected to the housing and retractable to an open position and extendable to a closed position. A spring assembly in the housing urges the latch into the closed position. The latch is forceably retracted by engagement with the strike when the side box is moved towards engagement with the base box.

The spring assembly urges the latch back into the closed position over the strike when the side box is engaged with the base box, thus latching the side box to the base box.

A release is connected to the housing and linkage connected to the spring assembly and the latch. The release is manually movable from a disengaged position to an engaged position. In the engaged position, the release compresses the spring assembly and retracts the latch, moving it from the closed position to the open position. With the latch in the open position, the strike is released, permitting separation of the side box from the base box.

A reset is also connected to the housing, and may have a reset paddle that is engageable with the bottom side of the side box. When the side box is moved towards the base box, the side box pushes the reset paddle into the compressed position. When the side box moves away from the base box, the side box releases the reset paddle, moving it to an uncompressed position. The uncompressed reset operably moves the engaged release into the disengaged position, causing the latch to return to the closed position by operation of the spring assembly. This occurs automatically when the side box moves away from engagement with the base box and the reset paddle.

As will be understood by one of ordinary skill in the art, the assembly disclosed may be modified and the same advantageous result obtained.

BRIEF DESCRIPTION OF THE DRAWINGS

The objects and features of the invention will become more readily understood from the following detailed description and appended claims when read in conjunction with the accompanying drawings in which like numerals represent like elements.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

Figure 1:
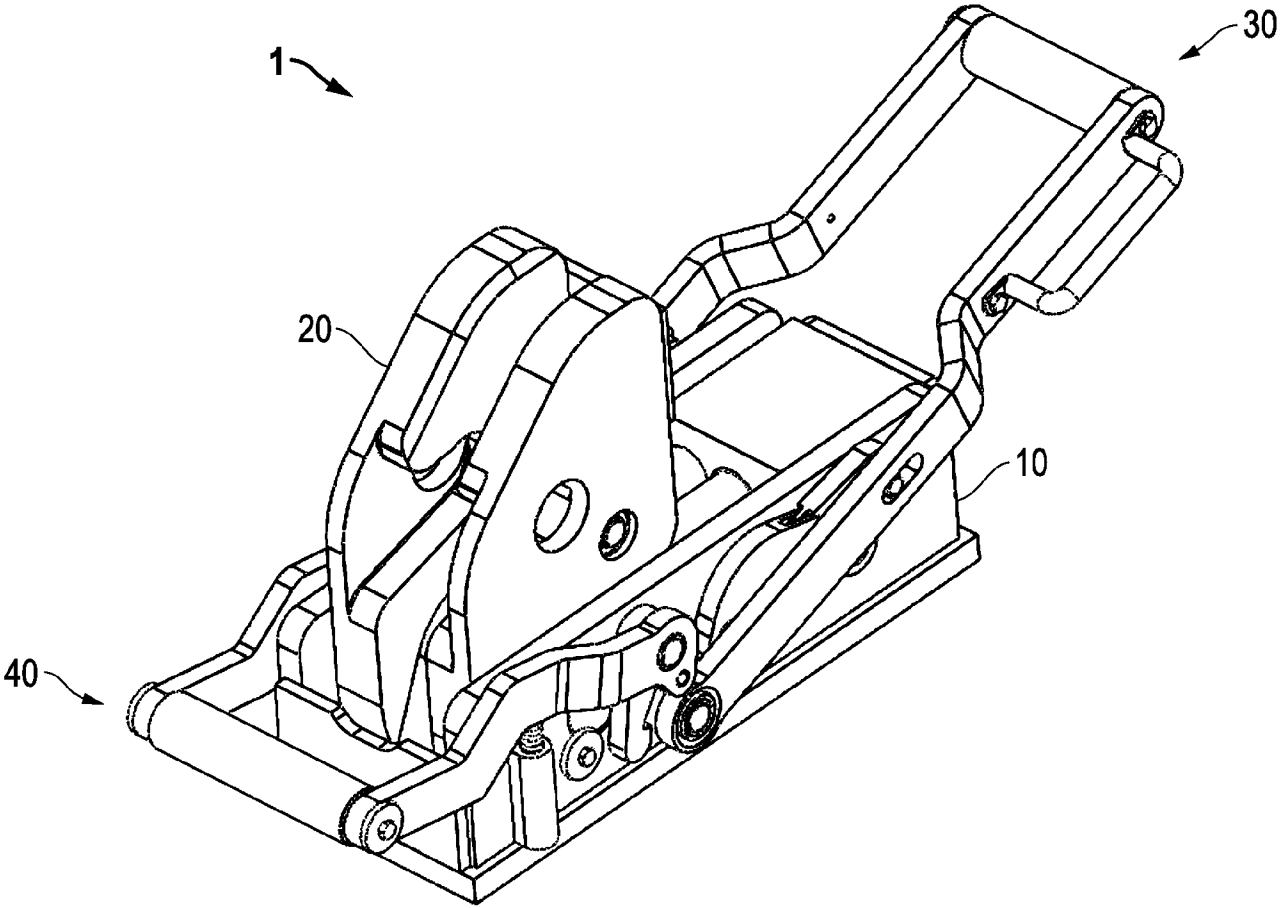
FIG. 1 is an isometric view of one embodiment of the substructure lock mechanism of the present invention, illustrating the lock mechanism in the receive position. In this position, the latch is in the closed position, the release in the unengaged position, and the reset in the uncompressed position.
Figure 5:
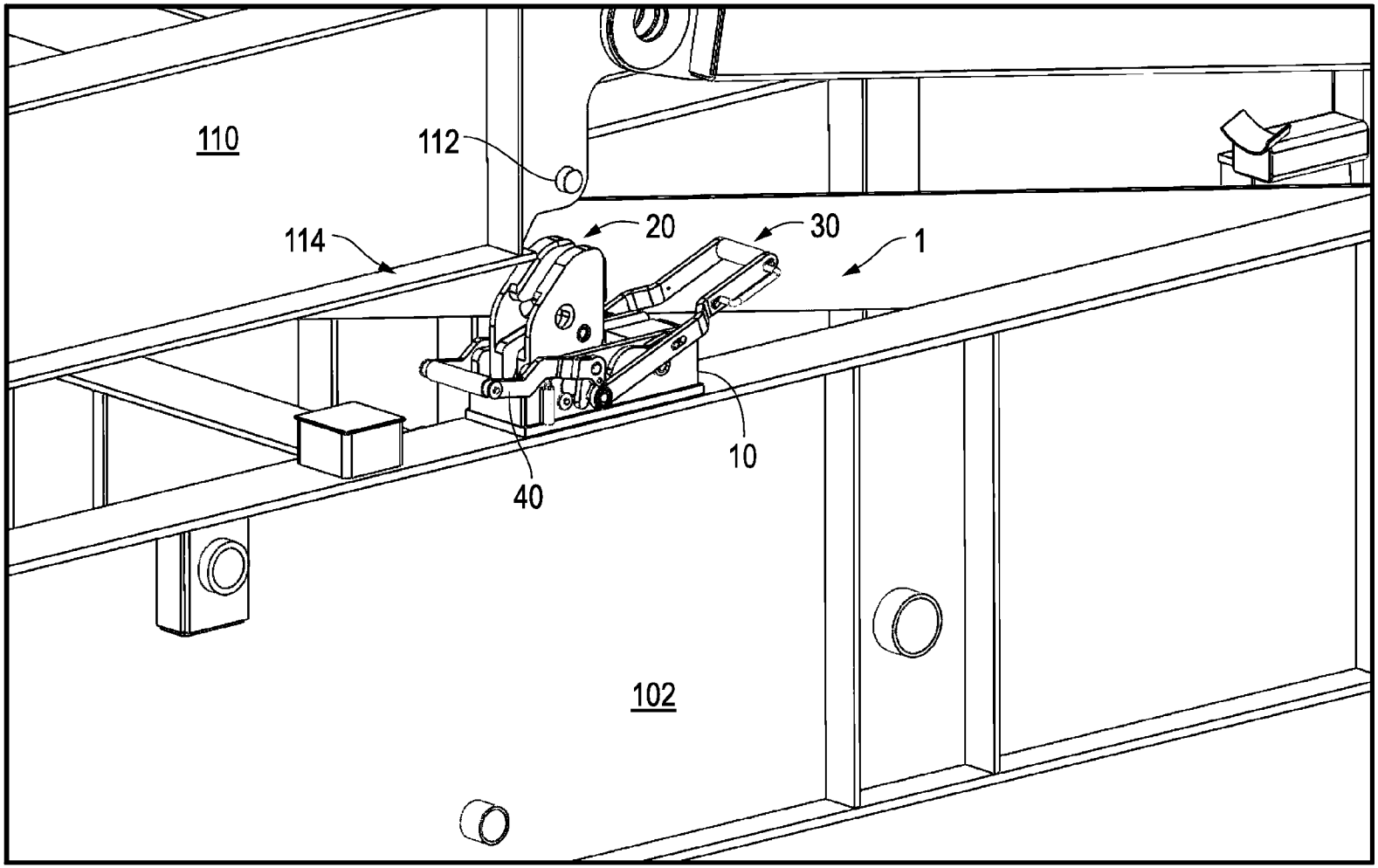
FIG. 5 is an isometric view of an embodiment of the substructure lock mechanism of the present invention, illustrating the lock mechanism in the receive position, with the side box approaching the base box.

FIG. 1 is an isometric view of one embodiment of substructure lock 1 of the present invention, illustrated in the "receive" position. Substructure lock 1 has a housing 10. As seen in FIG. 5, housing 10 is secured by welding, mechanical fasteners, or other means to a base box 102 of a drilling rig 100 (not fully shown or indicated).

A latch 20 is pivotally attached to housing 10 and is movable between a closed and open position. As seen in FIG. 1, when substructure lock 1 is in the receive position, latch 20 is in the closed position. In this position, latch 20 can receive a strike 112 extending from side box 110 (see FIG. 5). Latch 20 will momentarily retract while receiving strike 112 (see FIG. 6), and then automatically return to the closed position to prevent separation of side box 110 from base box 102 (see FIGS. 2 and 7).

A release 30 is pivotally attached to housing 10 and is manually movable from a disengaged position to an engaged position. In FIG. 1, release 30 is illustrated in the disengaged position. In the engaged position (see FIGS. 3 and 8), release 30 will cause substructure lock 1 to move into a "release" position in which latch 20 moves to the open position. In the release position, side box 110 may be removed from engagement with base box 102 (see FIGS. 3 and 9).

A reset 40 is pivotally attached to housing 10. Reset 40 is movable between an uncompressed position and a compressed position. In FIG. 1, reset 40 is illustrated in the uncompressed position. Movement of reset 40 between the uncompressed and compressed positions is caused by engagement of reset 40 with side box 110 of a drilling rig 100 (see FIGS. 5-7). Movement of reset 40 from a compressed position to an uncompressed position causes release 30 to move from the engaged position to the disengaged position (see FIG. 10).

Figure 2:
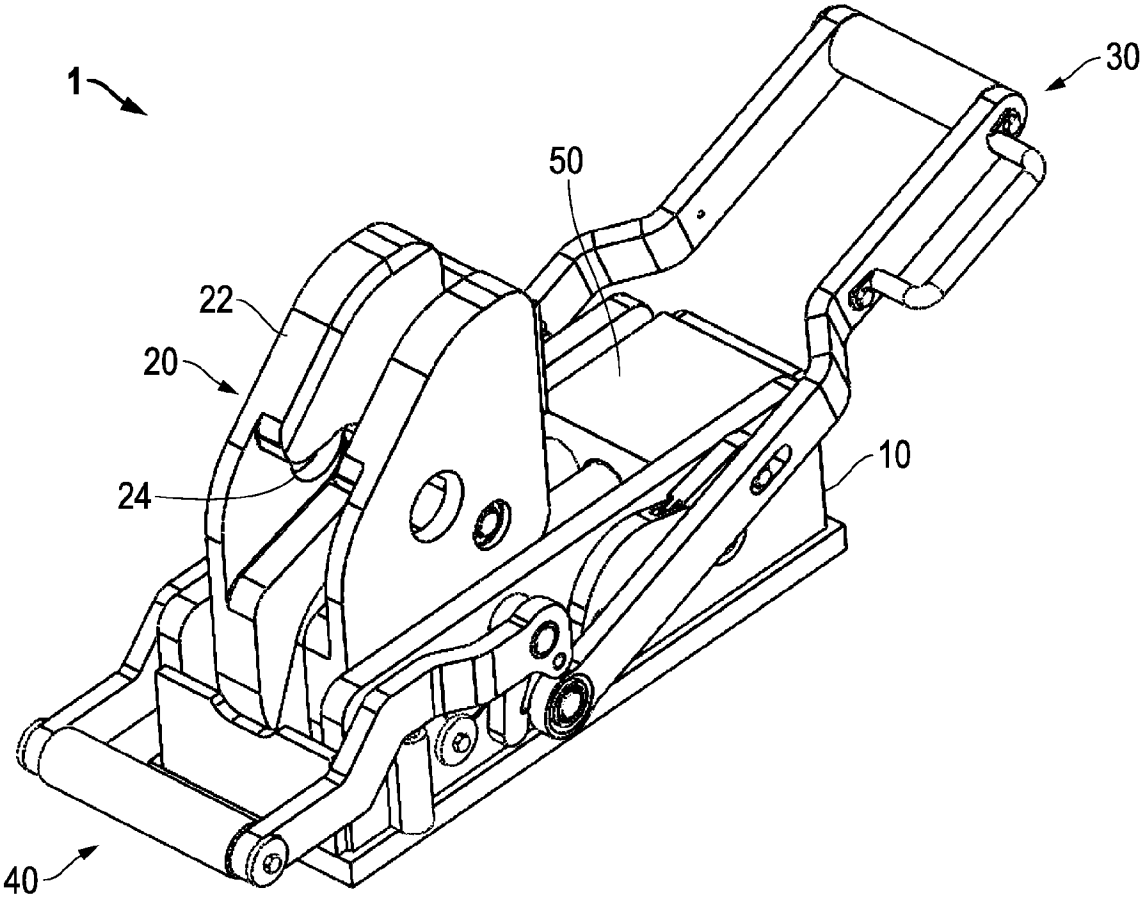
FIG. 2 is an isometric view of the substructure lock mechanism of FIG. 1, illustrating the lock mechanism in the latched position. In this position, the latch is in the closed position, the release in the unengaged position, and the reset in the compressed position.

FIG. 2 is an isometric view of substructure lock 1 of FIG. 1, illustrated with latch 20 in the latched position, release 30 in the unengaged position, and reset 40 in the compressed position. In this configuration, lock mechanism 1 has received strike 112 and is securing side box 110 to base box 102 (see FIG. 7).

In the embodiment illustrated, as side box 110 approaches base box 102, strike 112 engages a cam 22 of latch 20. Cam 22 is angularly disposed to cause rotation of latch 20 relative to housing 10. As strike 112 passes cam 22, a spring assembly 60 (see FIG. 4) urges latch 20 to return to the engaged position. In the embodiment illustrated, as latch 20 returns to the engaged position, a hook 24 portion of latch 20 extends over strike 112 of side box 110 to secure it in place against base box 102.

Figure 3:
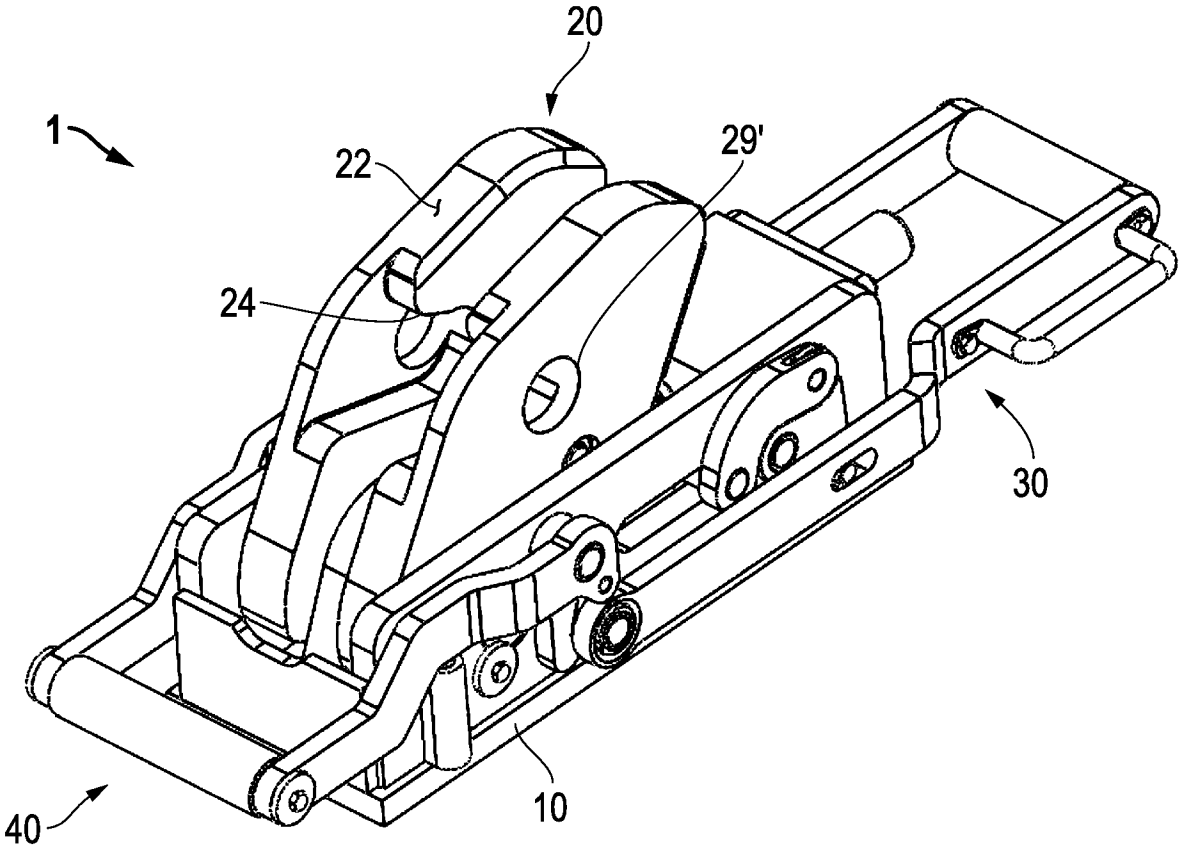
FIG. 3 is an isometric view of the substructure lock mechanism of FIG. 1, illustrating the lock mechanism in the release position. In the position, the latch is in the open position, the release in the engaged position, and the reset in the compressed position.

FIG. 3 is an isometric view of substructure lock 1 of FIGS. 1 and 2, illustrated with latch 20 in the unlatched position, release 30 in the engaged position, and reset 40 in the compressed position. In this configuration, release 30 has been manually moved into the engaged position, retracting latch 20 to allow side box 110 to be removed from engagement from base box 102. However, side box 110 has not yet been removed from engagement from base box 102, as it continues to hold reset 40 in the compressed position (see FIG. 8).

Figure 4:
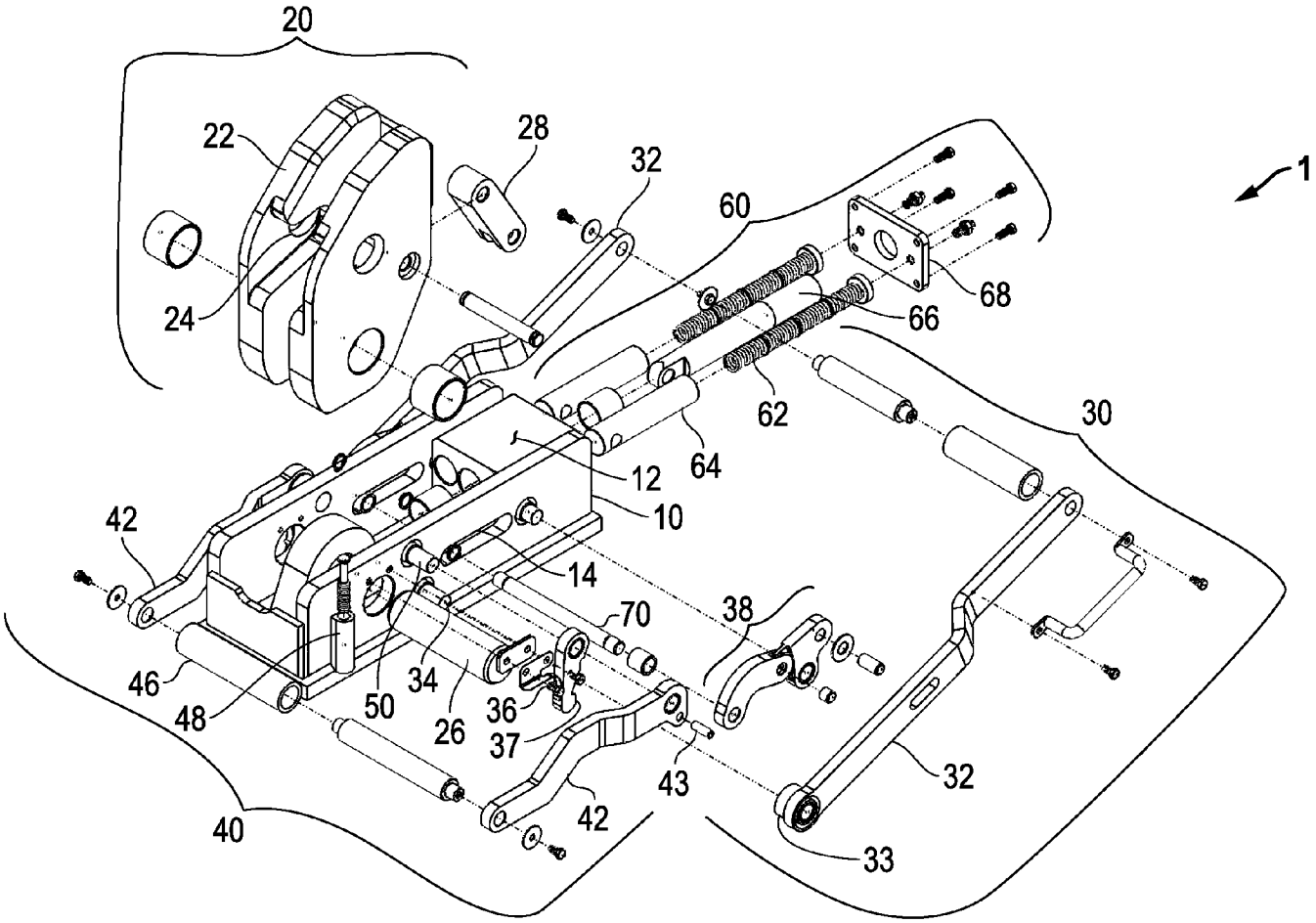
FIG. 4 is an isometric exploded view of the substructure lock mechanism of FIGS. 1 through 3.

FIG. 4 is an isometric exploded view of substructure lock 1. As seen in FIG. 4, latch 20 has a cam surface 22 and a hook 24. A latch pin 26 pivotally connects latch 20 to housing 10. A latch link 28 is pivotally connected between latch 20 and a spring rod 70. Spring rod 70 articulates laterally in a slot 14 on housing 10.

Release 30 has a release lever 32 pivotally connected to housing 10 on a lever pin 34. In the embodiment illustrated, a key slot 33 is located on release lever 32 proximate to its pivotal connection to lever pin 34.

A release lock 36 is pivotally connected to housing 10 by a reset pin 50, and movable between a locked position and an unlocked position. Release lock 36 has a lock hook 37 engageable with key slot 33 on lever 32, to lock release lever 32 in the engaged position.

A release linkage 38 connects release lever 32 to spring rod 70. Release linkage 38 translates force from rotational movement of release lever 32 to horizontal movement of spring rod 70 in slot 14. At the same time, latch link 28 translates the resultant horizontal movement of spring rod 70 into retraction of latch 20. Conversely, engagement of strike 112 with latch 20 forces rotation of latch 20 and through latch link 28.

Reset 40 has a reset lever 42 pivotally connected to housing 10 on reset pin 50. A reset paddle 46 extends from reset lever 42 for engagement with side box 110 or alternatively to a reset strike bar 114 extending from side box 110. A reset spring 48 urges reset 40 into the uncompressed position, which causes release 30 to move from the engaged position to the disengaged position.

A reset pin 43 transmits rotation of reset lever 42 to release lock 36. By this connection, movement of reset 40 from the compressed position to the uncompressed position disengages release lock 36 from key slot 33, allowing spring assembly 60 to push release 30 into the disengaged position and latch 20 into the closed position.

Spring assembly 60 has one or more springs 62. In the illustrated embodiment, springs 62 are partially positioned inside spring sleeves 64. A spring block 12 in housing 10 has apertures for receiving sleeves 64 in sliding relation. Sleeves 64 are pin connected to spring rod 70 at one end of springs 62. The opposite end of springs 62 are abutted to an end cap 68 that secures them in place inside spring block 12 of housing 10.

Also in the embodiment illustrated, a visible indicator 66 is located in spring block 12 in sliding relation. In the embodiment illustrated, indicator 66 is connected to spring rod 70 such that if spring rod 70 is forced towards end cap 68, compressing spring assembly 60, indicator 66 extends beyond end cap 68, alerting crew members that substructure lock 1 is in the release position, and side box 110 is not latched to base box 102.

Manual downward movement of release lever 30 into the engaged position compresses spring assembly 60, and moves latch 20 into the open position. The downward force on release lever 30 is necessary until the point is reached in which release lock 36 engages key slot 33 on lever 32 to lock release lever 32 in the engaged position. The weight of side box 110 on reset 40 keeps release lock 36 engaged with key slot 33.

Figure 12:
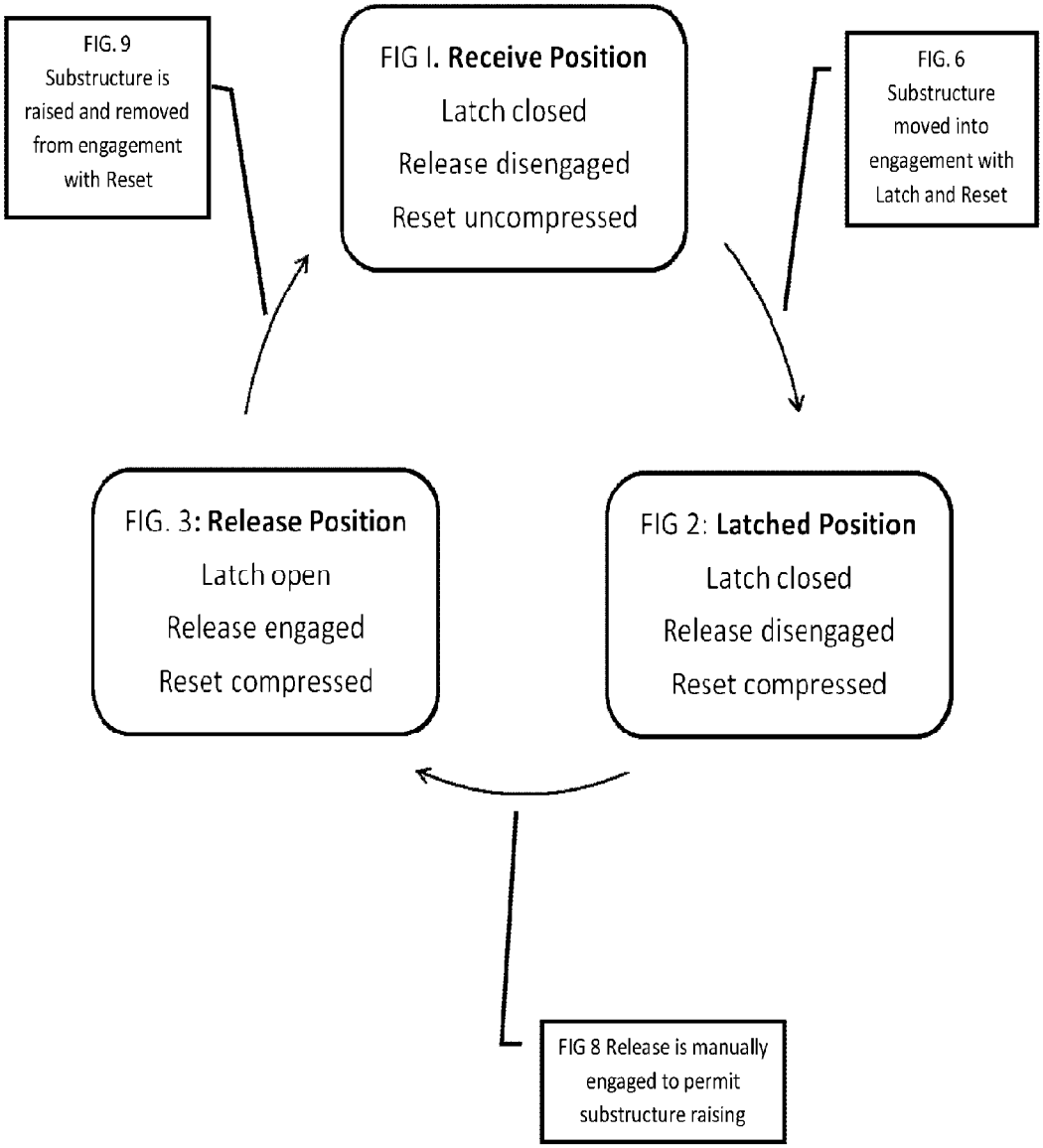
FIG. 12 is a diagrammatic representation of the three static positions of the substructure lock mechanism of the present invention, and the coincident positions of the latch, release, and reset.

FIG. 5 is an isometric view of the embodiment of substructure lock 1, illustrated in the same position as in FIG. 1, and shown mounted on base box 102. For example, substructure lock 1 may be mounted on the centerline of the upper beam of base box 102. Referring ahead to FIG. 12, this is the receive position of substructure lock 1, in which latch 20 is closed, release 30 is disengaged, and reset 40 is uncompressed. In this view, side box 110 is approaching base box 102, and substructure lock 1 is ready to receive side box 110.

Figure 6:
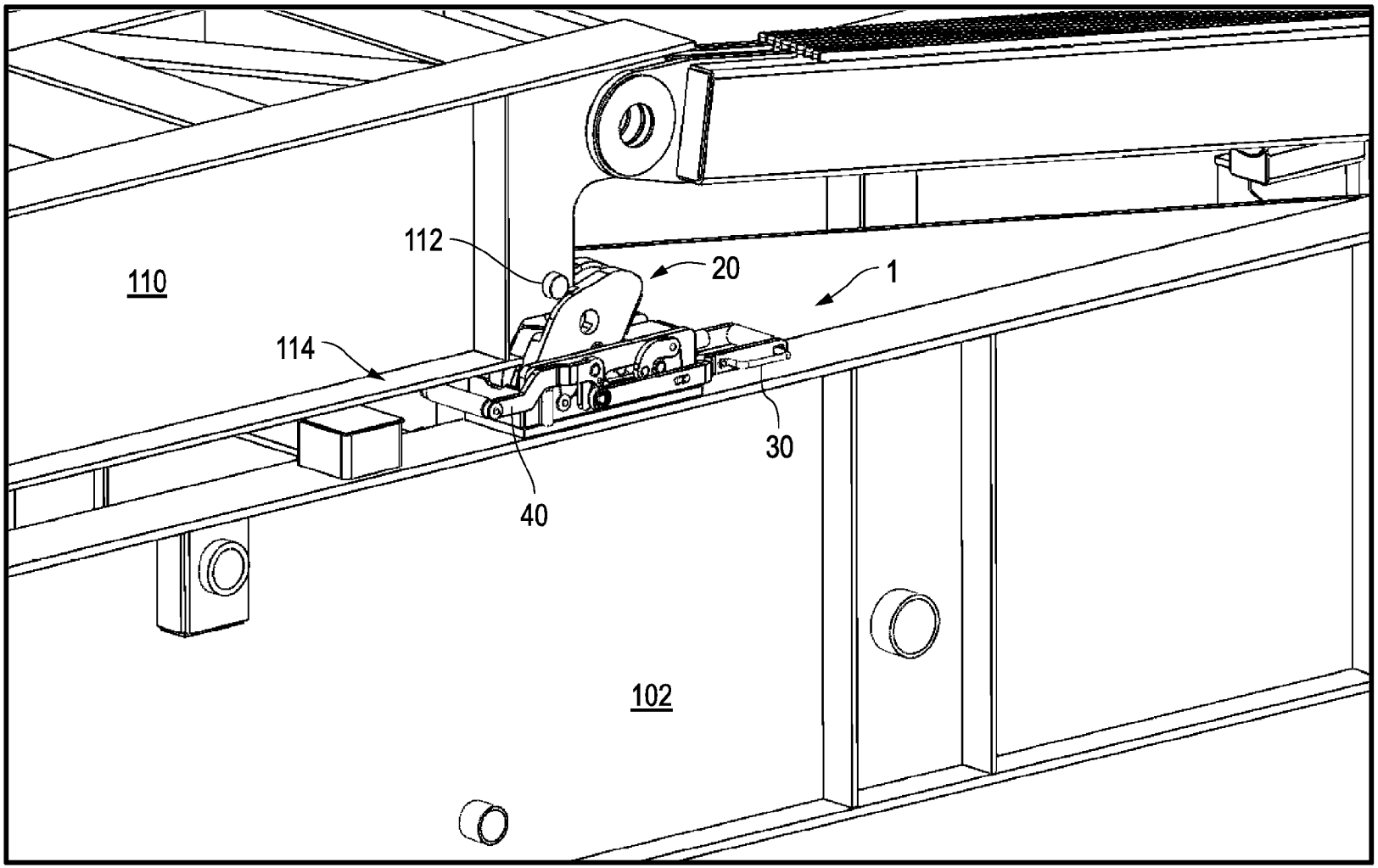
FIG. 6 is an isometric view of the substructure lock mechanism of FIG. 5, illustrating the strike of the substructure engaging the latch and forcibly retracting the latch.

FIG. 6 is an isometric view of the embodiment of substructure lock 1 illustrated in FIG. 5, showing strike 112 of side box 110 engaging cam surface 22 of latch 20, and forcibly retracting latch 20. Referring to FIG. 4, forced retraction of latch 20 compresses spring assembly 60, and momentarily moves release 30 towards the engaged position until strike 112 passes cam surface 22 of latch 20. At that point, spring assembly 60 urges latch 20 into the closed position as the hook portion of latch 20 captures strike 112, allowing release 30 to return to the unengaged position. As substructure 110 progresses downward, some portion of substructure 110, such as substructure frame 114 or a reset strike 116 (FIG. 11) extending from it, engages reset 40, moving it from the uncompressed position to the compressed position.

Figure 7:
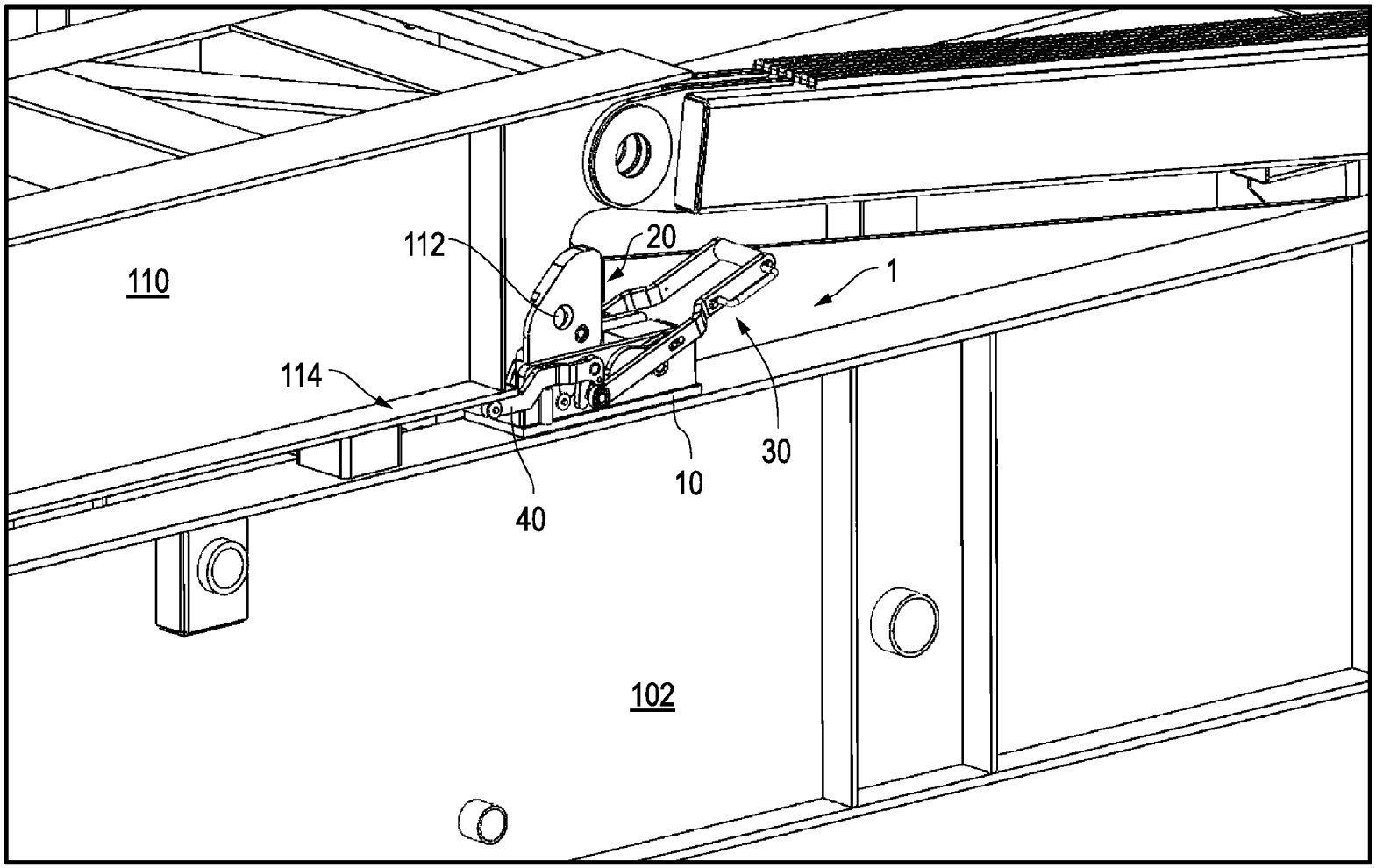
FIG. 7 is an isometric view of the substructure lock mechanism of FIG. 6, illustrating the lock mechanism in the latched position, with the latch secured over the strike to lock the side box against the base box.

FIG. 7 is an isometric view of the embodiment of substructure lock 1 illustrated in the same position as in FIG. 2, now shown mounted on base box 102. Referring ahead to FIG. 12, this is the latched position of substructure lock 1, in which latch 20 is closed, release 30 is disengaged, and reset 40 is compressed. In this view, side box 110 is resting on base box 102. Substructure lock 1 is latched over strike 112 of side box 110, safely securing it in place, so as to prevent errant separation of side box 110 from base box 102 during mast raising or transport.

Figure 8:
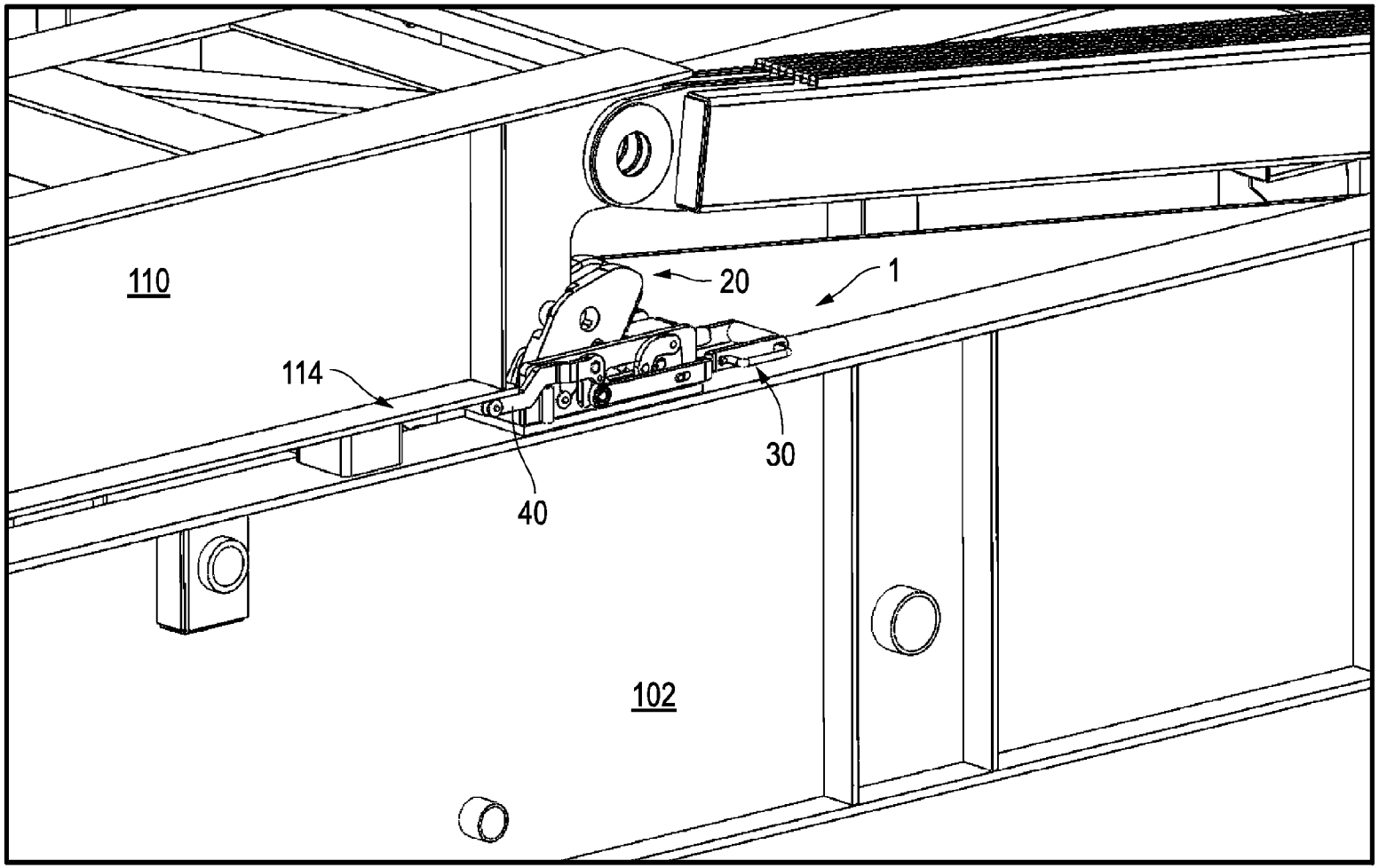
FIG. 8 is an isometric view of the substructure lock mechanism of FIG. 7, illustrating the lock mechanism in the release position, with the side box free to be raised above the base box, but still compressing the reset of the lock mechanism.

FIG. 8 is an isometric view of the embodiment of substructure lock 1 illustrated in the same position as in FIG. 3, now shown mounted on base box 102. Referring ahead to FIG. 12, this is the release position of substructure lock 1, in which latch 20 is open, release 30 is engaged, and reset 40 remains compressed. In this view, side box 110 is still resting on base box 102 and thus compressing reset 40. Release 30 has been manually pulled into the engaged position. Alternatively, release 30 is otherwise intentionally moved, such as by hydraulic and/or electronic control. Referring to FIG. 4, engagement of release 30 compresses spring assembly 60 and moves latch 20 into the open position. In this position, side box 110 may be separated from base box 102 to raise substructure 110.

Figure 9:
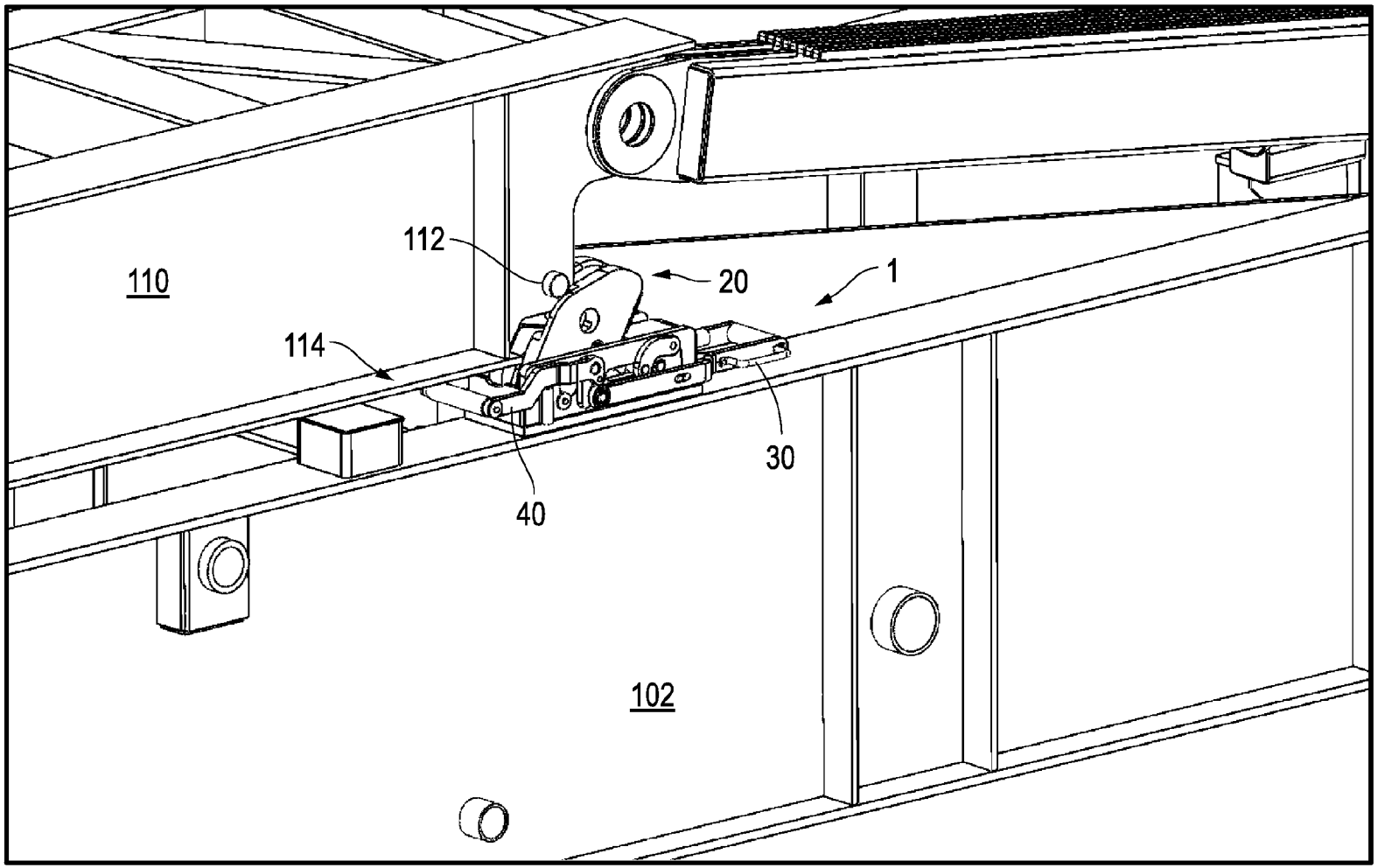
FIG. 9 is an isometric view of the drill floor to substructure lock mechanism of FIG. 8, illustrating the side box being raised up and away from the base box.

FIG. 9 is an isometric view of the embodiment of substructure lock 1, illustrated in FIG. 8, illustrating side box 110 beginning to rise up from engagement with base box 102. In this view, substructure 110 continues to provide force on reset 40 until strike 112 has moved out from the possible grasp of hook 24 of latch 20 (see FIGS. 3 and 4).

Figure 10:
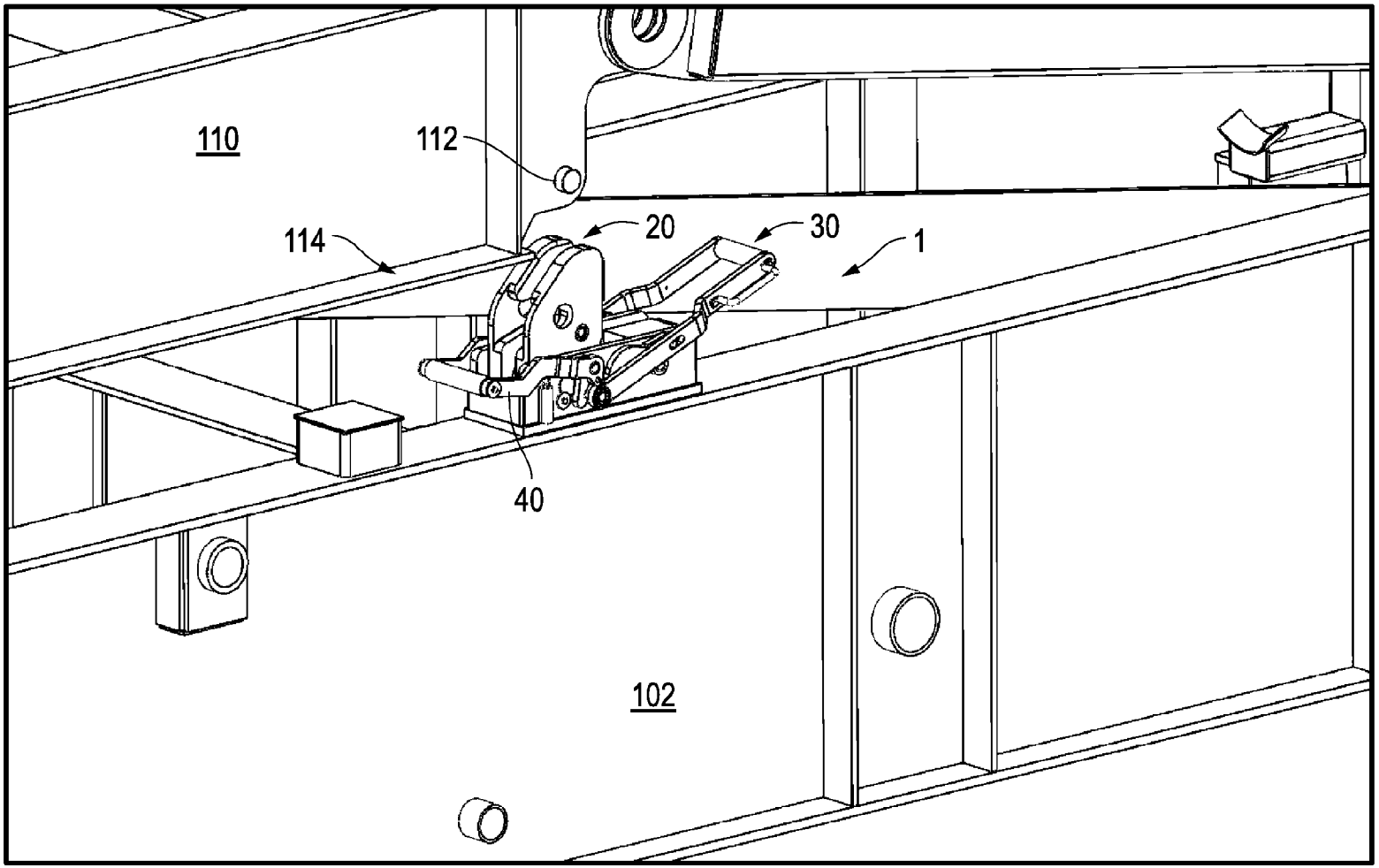
FIG. 10 is an isometric view of the substructure lock mechanism of FIG. 9, illustrating the side box raised above the base and fully disengaged from the lock mechanism, and the lock mechanism having returned itself to the receive position.

FIG. 10 is an isometric view of the drill floor to substructure connection system of FIG. 9, illustrating side box 110 continuing to rise away from base box 102 and now fully disengaged from reset 40 of substructure lock 1, allowing it to move to the uncompressed position as may be urged by reset spring 48 (FIG. 4). As reset lever 42 raises up, release lock 36 rotates from the locked position to the unlocked position, in which lock hook 37 disengages key slot 33 on lever 32. This causes release 30 to pivot out of the engaged position and into the disengaged position automatically upon movement of side box 110 away from base box 102. As a result, substructure lock 1, as illustrated in FIG. 10, has returned to the receive position as illustrated in FIGS. 1 and 5.

As described, the only physical interface the drilling crew has with substructure lock 1 is to manually move it (or with fitted hydraulic and/or electronic controls) into the release position for raising side box 110 of drilling rig 100. Advantageously, there is no other interface needed between the drilling crew and substructure lock 1. A further advantage is that substructure lock 1 automatically and immediately returns to the receive position upon separation of side box 110 from base box 102. If unforeseen circumstances require the immediate lowering of side box 110 back onto base box 102, substructure lock 1 will be ready to again receive and secure side box 102 from the moment side box 110 is disengaged from substructure lock 1.

Figure 11:
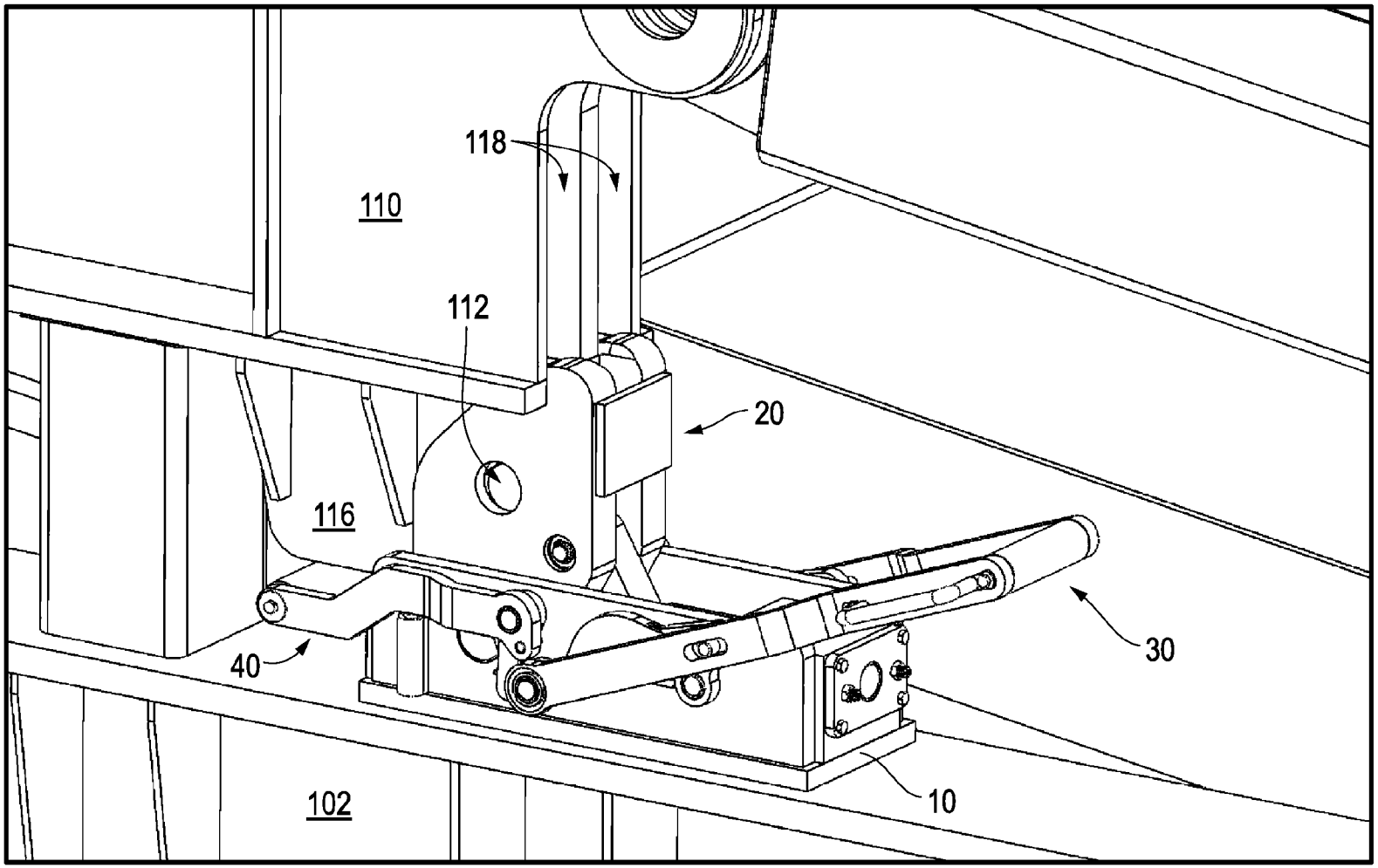
FIG. 11 is an isometric view of an alternative embodiment, illustrating complementary configuration of the substructure frame for receiving the substructure lock mechanism, and providing a reset strike for engaging the reset of the substructure lock mechanism.

FIG. 11 is an isometric view of an alternative embodiment, illustrating a complementary configuration of substructure 110 framework for engaging substructure lock 1. In a first alternative embodiment, one or more recesses 118 are formed on side box 110 to provide clearance for unencumbered operation of latch 20.

In a second alternative embodiment, side box 110 is modified to provide controlled engagement with reset 40. In this embodiment, a reset strike bar 116 extends from side box 110 for complementary engagement with reset paddle 46 of reset 40.

In another alternative embodiment, latch 20 has a viewport through which strike 112 is viewable when lock mechanism 1 is in the latched position. By this means, crew members can easily verify that side box 110 is properly locked to base box 102.

FIG. 12 is a diagrammatic representation of the three static positions of substructure lock 1, and the relative positions of latch 20, release 30, and reset 40. The embodiment thus described provides a substructure lock 1 designed for sustained configuration in three positions. Importantly, the described embodiment discloses a substructure lock 1 capable of self-positioning between two of the three positions, and requiring deliberate interaction to be moved into the third position (release position).

The first position of substructure lock 1 is a "Receive Position" in which substructure lock 1 is ready to receive side box 110. When substructure lock 1 receives side box 110, it automatically snaps into its second position.

The second position is the "Latched Position" in which substructure lock 1 secures side box 110 to base box 102. To release side box 110 from base box 102, release 30 of substructure lock 1 must be manually engaged, placing substructure lock 1 in its third position.

The third position is the "Release Position" in which substructure lock 1 is unlatched from side box 110, which may then be moved away from base box 102. As side box 110 is moved away from base box 102, substructure lock 1 automatically cycles back into position 1, and is again ready to receive side box 110.

As used herein, the term "substantially" is intended for construction as meaning "more so than not."

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

The invention claimed is:

1. A drilling rig substructure locking system comprising:
a strike connected to a bottom side of a side box of a drilling rig substructure; and,
a lock mechanism affixed to a top side of a base box of the drilling rig substructure;
the lock mechanism comprising:
a housing;
a latch pivotally connected to the housing and retractable to an open position and extendable to a closed position;
the latch forcibly retracted when engaged by the strike of the side box when the side box is moving towards engagement with the base box;
a release connected to the housing and being manually movable from a disengaged position to an engaged position;
a linkage connection between the latch and the release operable to move the latch into the open position when the release is moved into the engaged position;
a spring assembly in the housing, the spring assembly urging the latch into the closed position and the release into the disengaged position;
a reset connected to the housing, the reset engageable with the side box; and,
the reset engageable with the release, and operable to move the release to the disengaged position when the side box moves out of engagement with the reset.

2. The side box of claim 1 further comprising:
the strike extending downward from the bottom side of a side box.

3. The side box of claim 1 further comprising:
a reset strike extending downward from the side box; and, the reset strike engaging the reset when the side box approaches contact with the base box.

4. The latch of claim 1 further comprising:
a cam lug engageable with the strike; and,
a hook engageable over the strike.

5. The substructure locking mechanism of claim 1, the reset further comprising:
a reset spring urging the reset into the direction of the side box.

6. The substructure locking mechanism of claim 1 further comprising:
an indicator connected to and extending from the housing when the latch is in the open position; and,
the indicator retracting into the housing when the latch is in the closed position.

7. The substructure locking mechanism of claim 4, further comprising:
a viewport in the latch; and,
the strike being aligned with the viewport when the latch is in the closed position and the strike is positioned beneath the hook.

8. The substructure locking mechanism of claim 1 further comprising:
a rod slot located on the housing;
a spring rod located in the rod slot;
the spring assembly connected to the spring rod;
a latch link pivotally connected between the spring rod and the latch; and,
the spring assembly compressed between the spring rod and the housing to urge the latch into the closed position.

9. The substructure locking mechanism of claim 8, further comprising:
a release lever pivotally connected to the housing;
a release linkage connected between the release lever and the spring rod; and,
the release linkage operable to translate force from rotational movement of the release lever to horizontal movement of the spring rod in the slot.

10. The substructure locking mechanism of claim 1, further comprising:
a release lock pivotally connected to the housing, and being engageable with the release lever to lock the release lever in the engaged position.

11. A drilling rig substructure locking system comprising:
a lock mechanism affixed to a top side of a base box of the drilling rig substructure;
the lock mechanism engagable with a strike connected to a bottom side of a side box of the drilling rig substructure, and operable to lock the side box to the base box;
the lock mechanism moving automatically between a receive position and a latched position when the lock mechanism is engaged by the strike of the side box;
the lock mechanism requiring an operator interface to move the lock mechanism between the latched position and a release position; and, the lock mechanism moving automatically between the release position and the receive position when the side box is moved away from the latch mechanism.

12. A drilling rig substructure locking system comprising:

a lock mechanism affixed to a top side of a base box of the drilling rig substructure;

the lock mechanism engagable with a strike connected to a bottom side of a side box of the drilling rig substructure, and operable to lock the side box to the base box;

a latch movable between an open and closed position;

a release movable between an engaged position and a disengaged position;

a reset movable between an uncompressed and a compressed position;

the locking mechanism configured to rest in a receive position in which the latch is closed, the release is disengaged, and the reset in uncompressed;

the locking mechanism configured to rest in a latched position in which the latch is closed, the release is disengaged, and the reset in compressed beneath the side box; and, the locking mechanism configured to rest in a release position in which the latch is open, the release is engaged, and the reset in compressed.

13. A drilling rig comprising:

a collapsible substructure comprising a base box, a side box above the base box, and a plurality of legs pivotally connected between the base box and the side box;

a strike affixed to a bottom side of the side box;

a lock mechanism affixed to a top side of the base box;

the lock mechanism cyclable between a first receive position, a second latched position, and a third release position;

the lock mechanism being receivable of the strike when the lock mechanism is in the receive position;

the strike secured within the lock mechanism when the lock mechanism is in the latched position, preventing separation of the side box from the base box;

the lock mechanism releasing the strike when the lock mechanism is manually moved into the release position; and, wherein the side box is separable from the base box when the latch is in the release position.

14. A method of collapsing and erecting a drilling rig substructure having a base box and a side box, comprising the steps of:

lowering the side box towards the base box;

engaging a strike on a lower surface of the side box with a lock mechanism affixed to a top side of the base box;

allowing the lock mechanism to self-actuate into a latched position to secure the side box to the base box;

manually actuating the lock mechanism into a release position;

raising the side box away from the base box to erect the substructure; and, allowing the lock mechanism to self-actuate into a receive position;

and wherein the lock mechanism in the receive position is receivable of the strike of the side box when the substructure is again collapsed towards the base box.

* * * * *